US011673033B1

(12) United States Patent
Stearns et al.

(10) Patent No.: US 11,673,033 B1
(45) Date of Patent: Jun. 13, 2023

(54) CLIMBING EXERCISE APPARATUS

(71) Applicants: Kenneth W Stearns, Houston, TX (US); Joseph D Maresh, West Linn, OR (US)

(72) Inventors: Kenneth W Stearns, Houston, TX (US); Joseph D Maresh, West Linn, OR (US)

( * ) Notice: Subject to any disclaimer, the term of this patent is extended or adjusted under 35 U.S.C. 154(b) by 0 days.

(21) Appl. No.: 17/546,017

(22) Filed: Dec. 8, 2021

Related U.S. Application Data

(63) Continuation of application No. 16/785,556, filed on Feb. 7, 2020, now abandoned.

(60) Provisional application No. 62/918,675, filed on Feb. 7, 2019.

(51) Int. Cl.

| | |
|---|---|
| ***A63B 69/00*** | (2006.01) |
| ***A63B 22/04*** | (2006.01) |
| ***A63B 22/00*** | (2006.01) |
| ***A63B 21/00*** | (2006.01) |
| ***A63B 23/035*** | (2006.01) |

(52) U.S. Cl.
CPC ..... *A63B 69/0048* (2013.01); *A63B 22/04* (2013.01); *A63B 21/4033* (2015.10); *A63B 21/4034* (2015.10); *A63B 21/4035* (2015.10); *A63B 22/001* (2013.01); *A63B 23/035* (2013.01); *A63B 2022/0043* (2013.01)

(58) Field of Classification Search
CPC ... A63B 22/04; A63B 22/0005; A63B 22/001; A63B 22/0056; A63B 22/0058; A63B 22/0064; A63B 22/0069; A63B 22/0694; A63B 69/0048; A63B 21/4015; A63B 21/4019; A63B 21/4033; A63B 21/4034; A63B 21/4035; A63B 2022/0028; A63B 2022/003; A63B 2022/0043; A63B 2022/0074; A63B 2022/0094; A63B 23/035; A63B 23/03516; A63B 23/03575
See application file for complete search history.

(56) References Cited

U.S. PATENT DOCUMENTS

| | | | | |
|---|---|---|---|---|
| 5,040,785 | A * | 8/1991 | Charnitski | A63B 22/205 482/52 |
| 5,928,115 | A * | 7/1999 | Arroyo, Jr. | A63B 22/0605 482/62 |
| 9,358,421 | B2 * | 6/2016 | Mercenari Uribe | A63B 22/0066 |
| 10,272,286 | B2 * | 4/2019 | Liao Lai | A63B 22/04 |
| 10,507,354 | B2 * | 12/2019 | Kiani | A63B 21/00192 |
| 10,758,776 | B2 * | 9/2020 | Chen | A63B 71/0054 |
| 2019/0160331 | A1 * | 5/2019 | Mercenari Uribe | A63B 21/018 |
| 2020/0330820 | A1 * | 10/2020 | Stearns | A63B 21/4035 |
| 2020/0376332 | A1 * | 12/2020 | Silver | A63B 22/001 |

* cited by examiner

*Primary Examiner* — Megan Anderson
(74) *Attorney, Agent, or Firm* — Nick A Nichols, Jr.

(57) ABSTRACT

A climbing exercise apparatus having ipsilateral and contralateral modes of operation may include a frame supporting movable generally vertically oriented members. The vertically oriented members may include arm and foot support members rotatably connected to carriage members movably supported on the frame. The climbing exercise apparatus may include three-dimensional movement capabilities for a user's arms and feet to move through three dimensional paths of motion during an exercise activity.

12 Claims, 13 Drawing Sheets

CLIMBING EXERCISE APPARATUS

CROSS-REFERENCE TO RELATED APPLICATION

This application is a continuation of U.S. patent application Ser. No. 16/785,556, filed Feb. 7, 2020, which claims priority to and the benefit of the filing date of U.S. Provisional Application Ser. No. 62/918,675, filed Feb. 7, 2019, which applications are herein incorporated by reference in its entirety.

BACKGROUND

The present invention relates to fitness equipment of a category referred to as "climbing machines" or "stepping machines" where the foot exercise paths are substantially vertical.

During use of a climbing exercise machine, two coordinated body movements are generally possible. A first motion may be referred to as ipsilateral movement where a unison movement of the upper limb and the lower limb occur on the same side of a user, and a second motion referred to as contralateral movement where oppositional movement of an upper limb and lower limb occur on the same side of a user. The first motion of ipsilateral movement or straight climbing is more closely correlated with martial arts where martial arts typically employ ipsilateral movements, whereas the second motion of asymmetrical or cross climbing action is more closely correlated with oppositional exercises such as swimming and walking. In ipsilateral motion the body halves do not cooperate but move separately, and in contralateral motion both sides of the brain function at the same time in a coordinated manner.

The present invention discloses a novel apparatus which includes cross climbing and/or straight climbing with three dimensional movement capabilities on an exercise apparatus, and where the user may interactively create or generate visual or audio (music) output which is a result of infinite combinations of possible 3D paths of motion which the user's feet and/or hands move through during an exercise activity.

SUMMARY

A climbing exercise apparatus having ipsilateral and contralateral modes of operation may include a frame supporting movable generally vertically oriented members. The vertically oriented members may include arm and foot support members rotatably connected to carriage members movably supported on the frame. The climbing exercise apparatus may include three dimensional movement capabilities for a user's feet to move through three dimensional paths of motion during an exercise activity.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
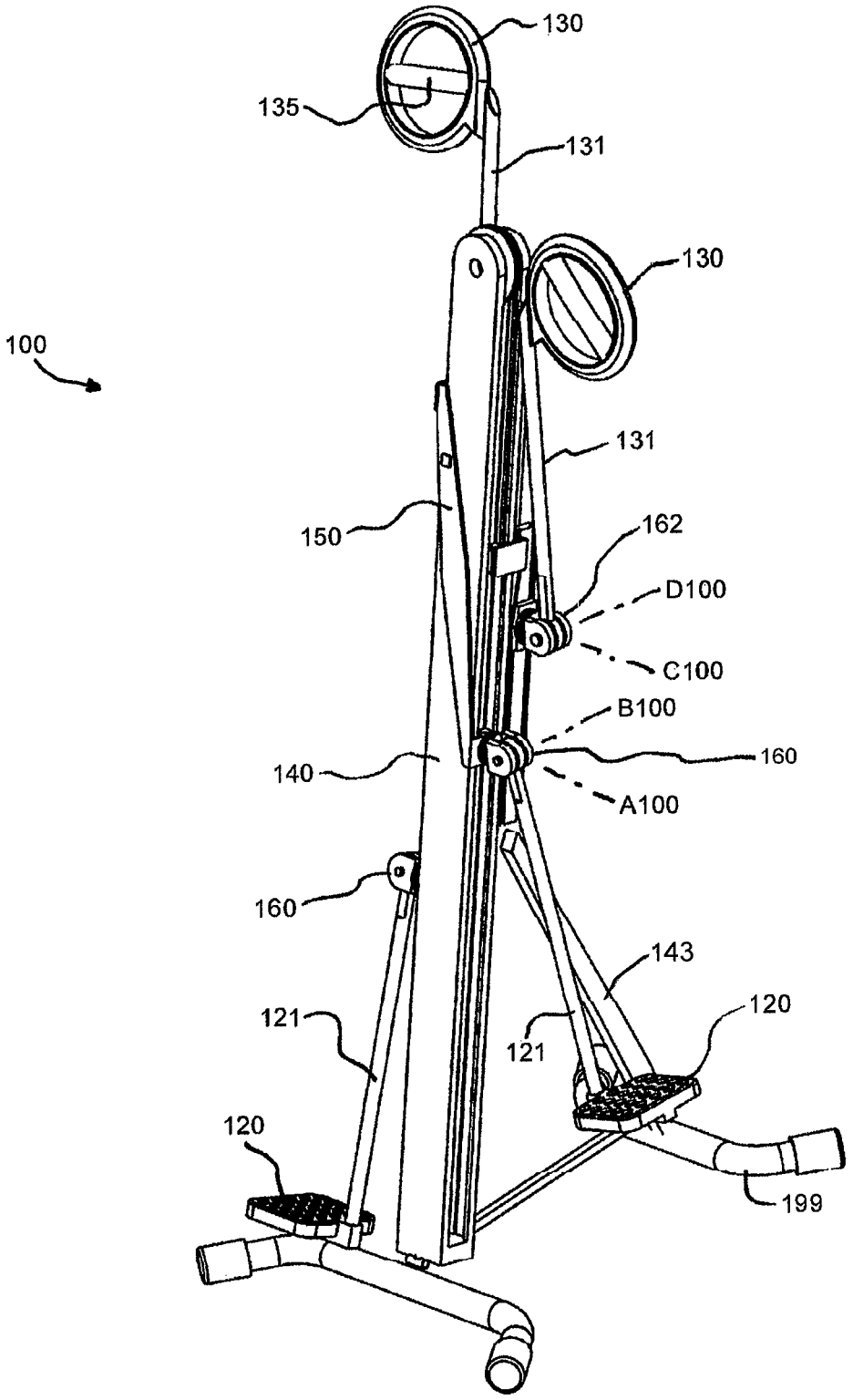
FIG. 1 is a perspective view of a climbing exercise apparatus.
Figure 2:
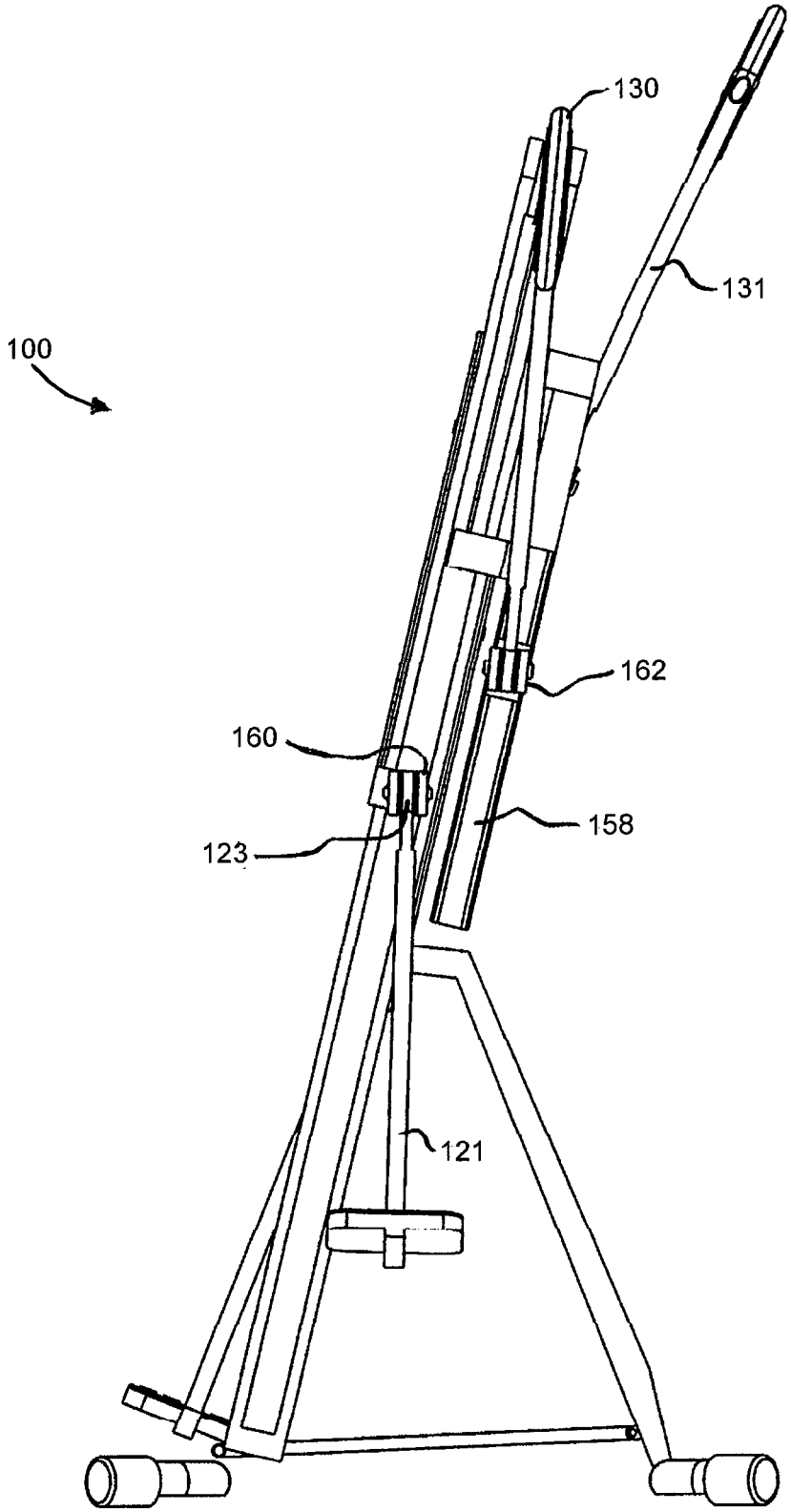
FIG. 2 is a side view of the climbing exercise apparatus shown in FIG. 1.
Figure 3:
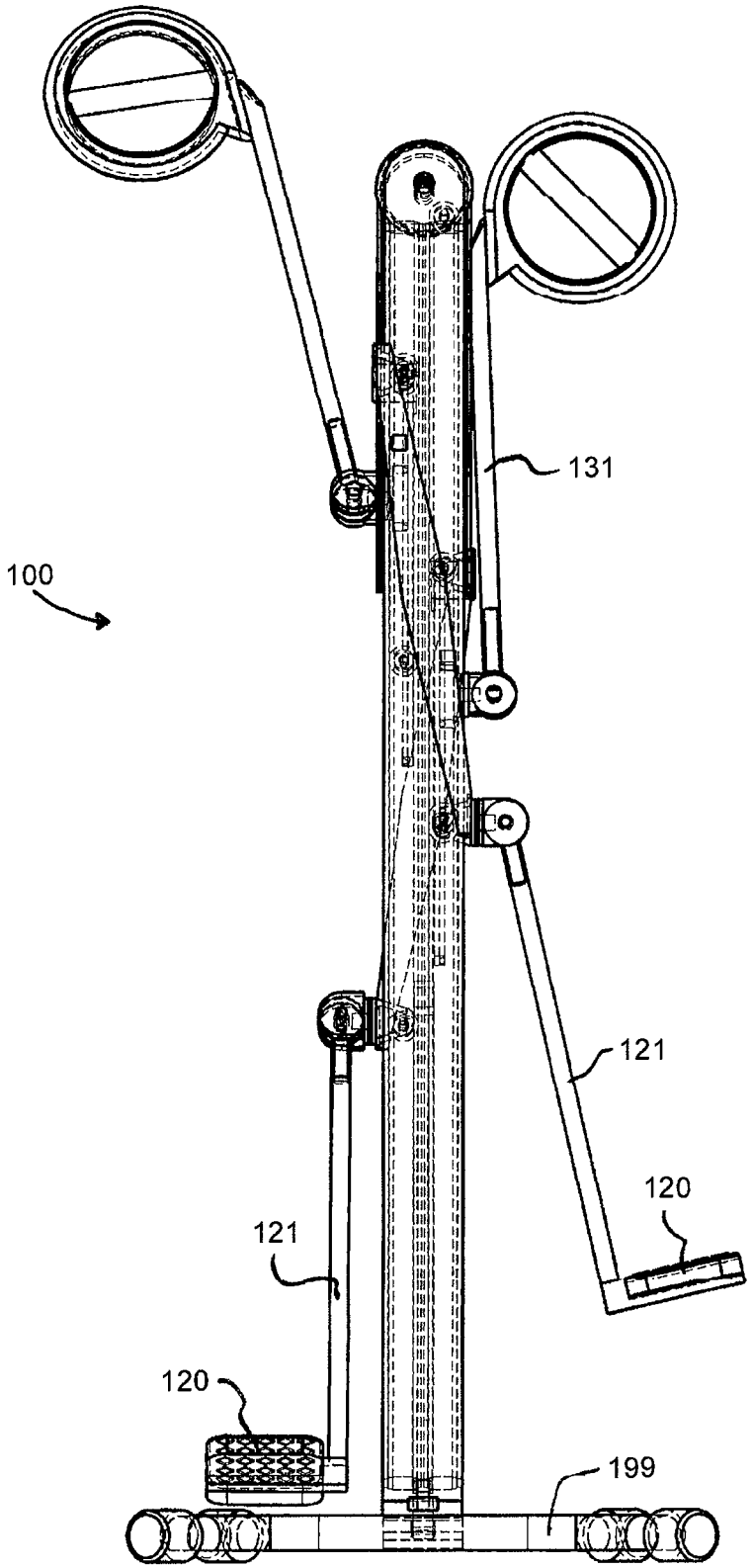
FIG. 3 is a front view of the climbing exercise apparatus shown in FIG. 1 with hidden lines shown.
Figure 4:
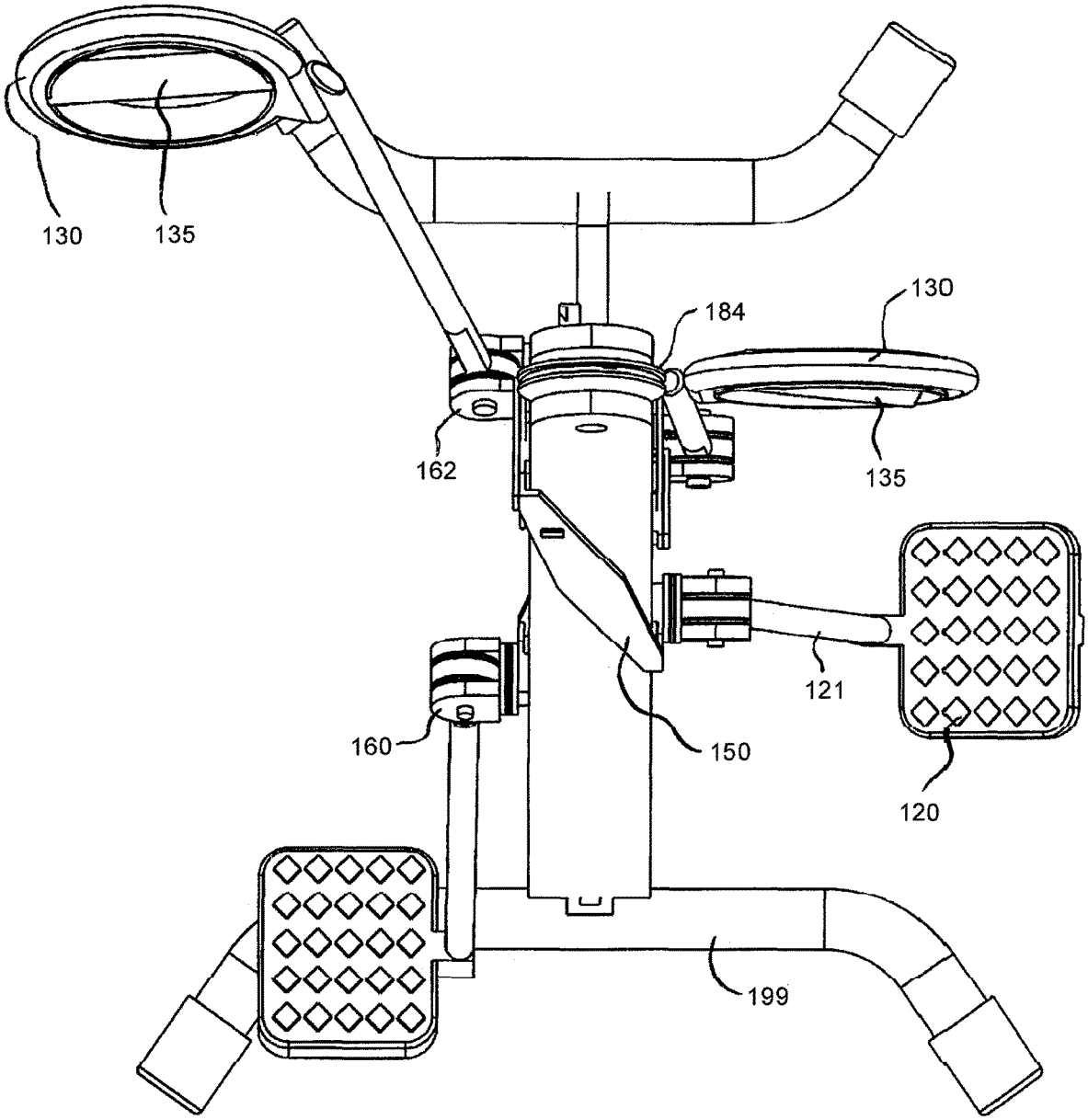
FIG. 4 is a top plan view of the climbing exercise apparatus shown in FIG. 1.
Figure 5:
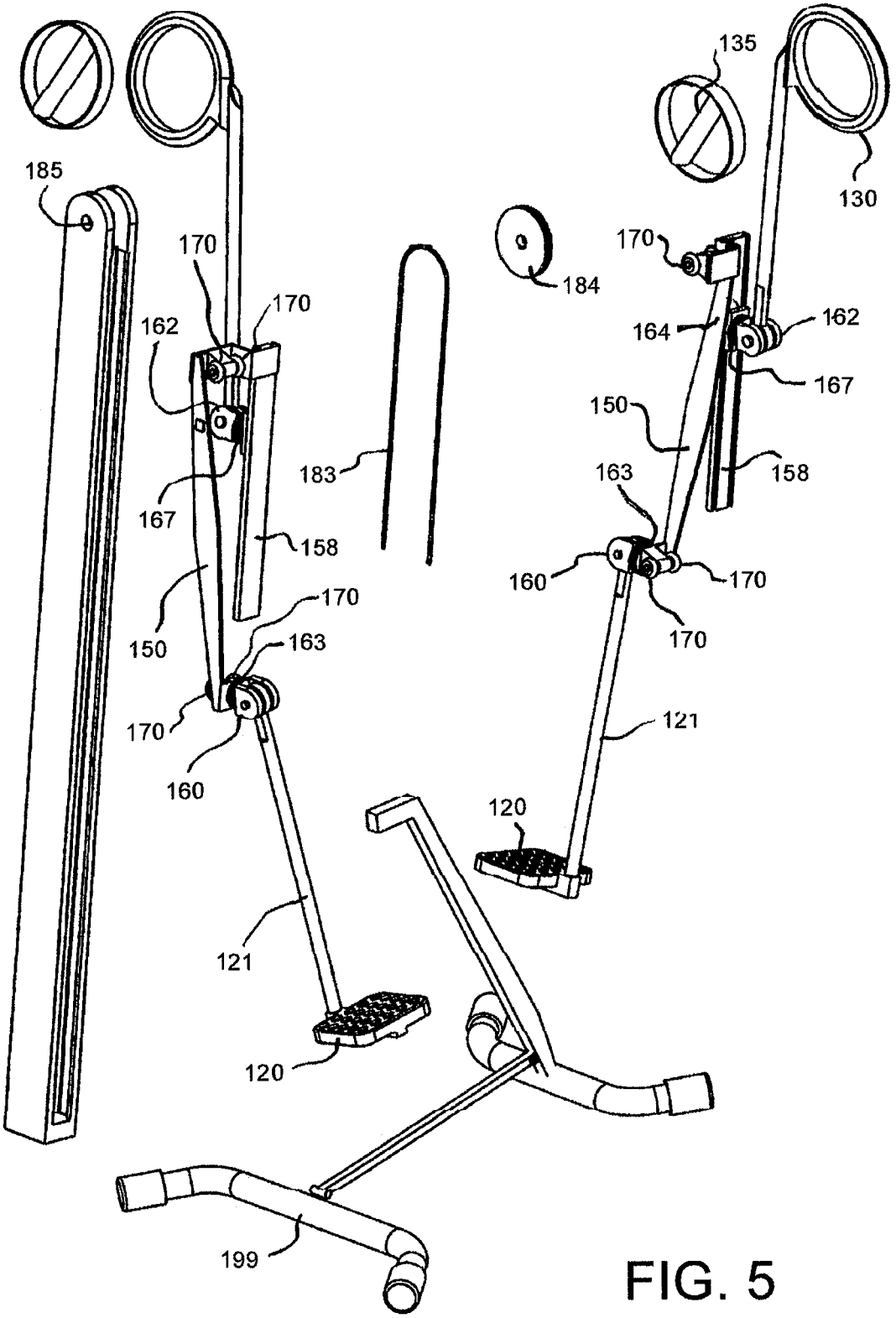
FIG. 5 is an exploded perspective view of the climbing exercise apparatus shown in FIG. 1.

Directing attention to the figures, a cross climbing exercise apparatus 100 is illustrated in FIG. 1. The exercise apparatus 100 may include a frame 199. A generally vertically extending stanchion 140 may be fixedly secured to the frame 199. A generally angularly extending brace member 143 may have a lower end secured to the frame 199 and an upper end connected to the stanchion 140. The stanchion 140 may be generally inclined forward toward the rear of the frame 199.

The stanchion 140 may include tracks or races along opposite sides thereof for rollers 170 to travel along in a reciprocating manner associated with vertical motion. Carriages 150 may be linearly constrained parallel to the stanchion 140 with rollers 170 rotatably secured proximate opposite regions of the carriages 150. Those skilled in the art will recognize that linear constraints may also include any style of linear bearing, including for example polymer bushings that slide along and are concentric with polished shafts (unillustrated). In the instance of bushings that concentrically slide along a linear shaft, at least two shafts would be required in order to prevent the carriages 150 from rotating about the linear shaft(s). A center pulley 184 may be rotatably secured to the stanchion 140 at journal 185, and a cable 183 may be routed over the pulley 184 while distal ends of cable 183 are secured to front and rear carriages 150 such that dependent vertical motion of the carriages 150 occurs. For example, as the user pushes down on a first foot platform 120 connected to a carriage 150, the other foot platform 120 connected to a carriage 150 will be caused to move up.

A foot platform 120 may be secured to a foot support member 121, where the foot support member 121 is connected proximate a lower region of a carriage 150. The foot support member 121 may be connected to the lower region of the carriage 150 in such a manner that in addition to allowing movement of the foot platform 120 generally up and down as the carriage 150 reciprocates, the foot platform 120 may move laterally, as well as fore and aft, thus providing for movement during exercise in all three dimensions (3D movement). Similarly, the hand grip 135 (which is secured to arm support 131) may move generally up and down as the carriage 150 reciprocates, and the hand grip 135 may also move laterally, as well as fore and aft, thus providing for movement at the user's arm as well as the user's feet to move in all three dimensions (3D movement) during exercise. In order to provide lateral and fore and aft movement of the foot platform 120 and hand grip 135, ball joints and the like may be utilized where foot support members 121 and arm support members 131 connect to carriage 150, however a double joint assembly described herein may function in a similar manner as a ball joint. A double joint assembly has the additional advantage of disallowing spinning of support members 121 and 131 about their respective axes during operation of the exercise apparatus 100.

Referring first to the connection of the foot member support 121 to the carriage 150 lower region, a first joint hub 163 having rotational axis A100 (FIG. 1) may be connected proximate a lower end of the carriage 150, and a second joint hub 160 having rotational axis B100 (FIG. 1) may be connected proximate the first joint hub 163. Friction disks may be utilized between opposed rotating surfaces as desired. In this manner, foot platform 120 may travel up or down as carriage 150 reciprocates along stanchion 140, while foot platform 120 may simultaneously move fore and aft about axis A100, and laterally side to side about axis B100. Potentiometers 191 (see FIG. 8) and the like may be incorporated into the hubs 163 and 160 in order to provide position feedback signals for numerous applications, which will be briefly discussed later herein.

Referring now to the user's arm/hand movements, an arm support member 131 is similarly connected to the carriage 150 upper region. A third joint hub 167 having rotational axis C100 (FIG. 1) may be connected proximate an upper end of the carriage 150, and a fourth joint hub 162 having rotational axis D100 (FIG. 1) may be connected proximate the third joint hub 167. In this manner, hand grip 135 may travel up or down as carriage 150 reciprocates along stanchion 140, while hand grip 135 may simultaneously move fore and aft about axis C100, and laterally side to side about axis D100. Potentiometers 191 and the like may be incorporated into the third and fourth hubs 167 and 162, respectively, in order to provide position feedback signals for numerous applications, which will be briefly discussed later herein. Friction disks, such as disk 169, may be utilized between opposed rotating surfaces as desired at any of the hub joints 160, 162, 163, and 167 in order to add resistance to the three-dimensional hand and/or foot motion.

Figure 6:
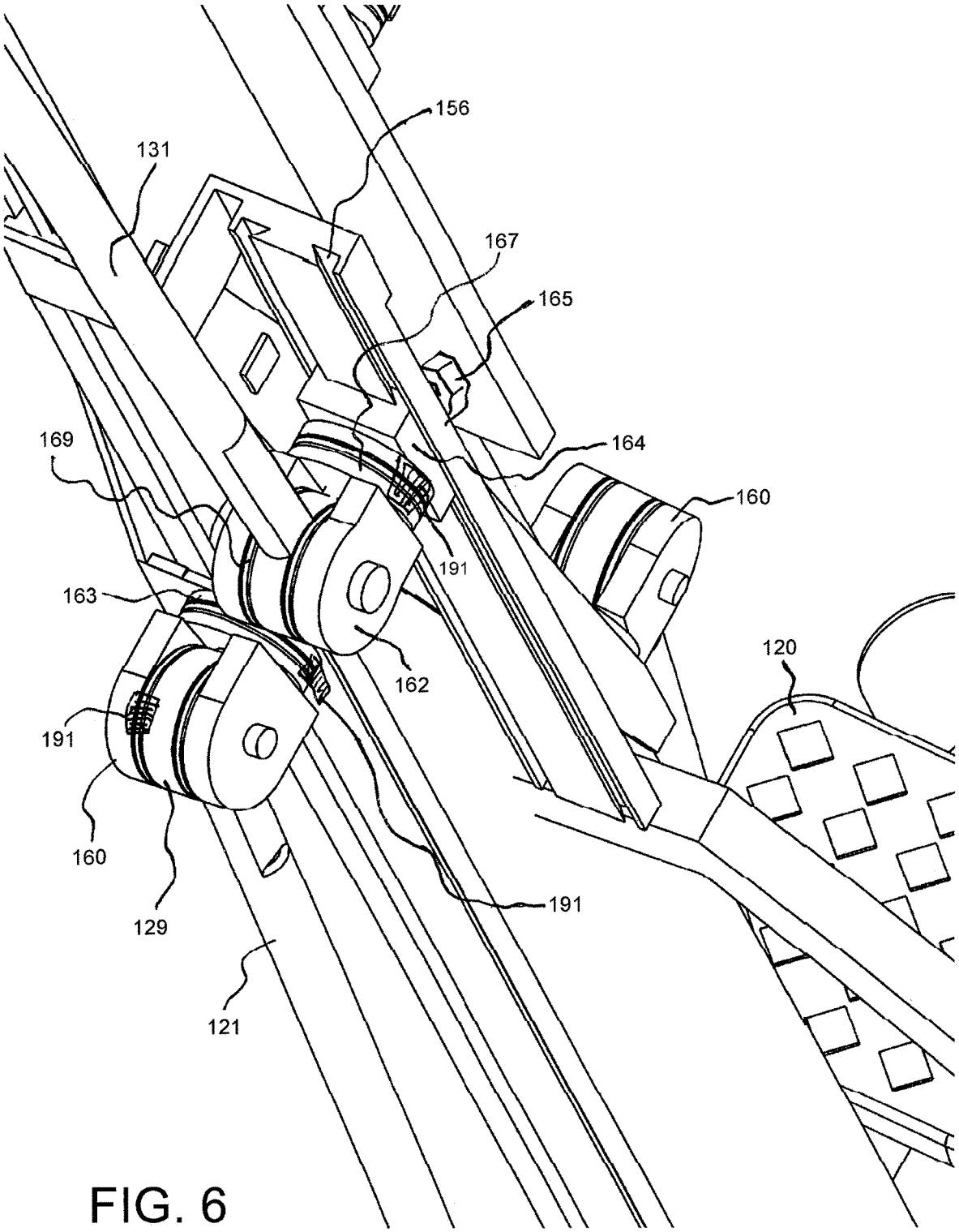
FIG. 6 is an enlarged partial perspective view of the climbing exercise apparatus shown in FIG. 1.
Figure 7A:
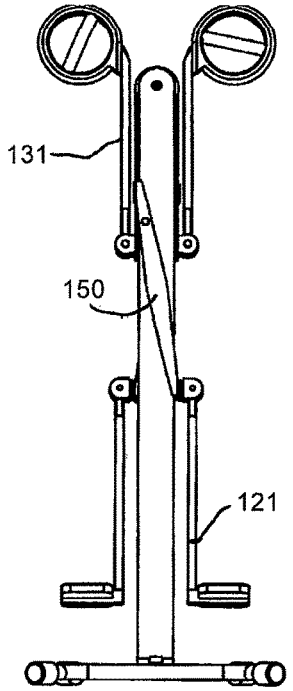
FIG. 7A is a front view illustrating a start position of the climbing exercise apparatus shown in FIG. 1.
Figure 7B:
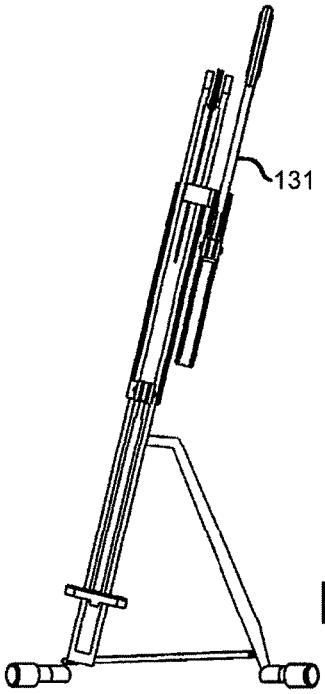
FIG. 7B is a side view of the climbing exercise apparatus shown in FIG. 7A.
Figure 7C:
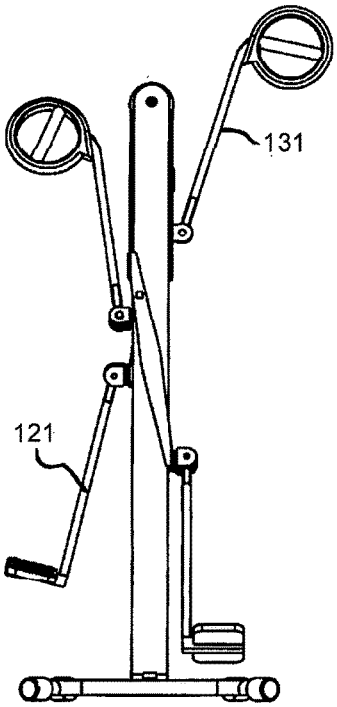
FIG. 7C is a front view illustrating vertical and three-dimensional movement of the climbing exercise apparatus shown in FIG. 7A.
Figure 7D:
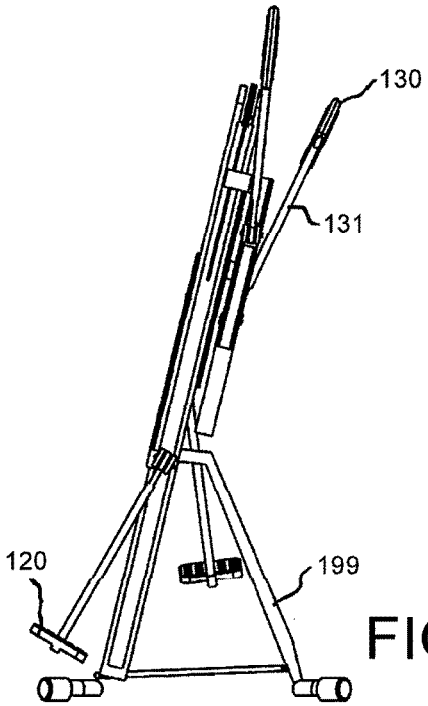
FIG. 7D is a side view of the climbing exercise apparatus shown in FIG. 7C.

A hand ring 130 may be rigidly secured to arm support members 131. Hand grip 135 may include a gripping surface as well as a circumferential race which is concentric with the hand ring 130 such that a user may rotate the hand grip 135 about the axis of the hand ring 130 during exercise in order to seek the most natural articulation of the user's wrist. Additionally, a potentiometer 191 and the like may be connected between the hand grip 135 and the hand ring 130 in order to provide further interactive capability of the exercise apparatus 100 with any one of numerous possible computer applications. In order to accommodate different user heights, the hand member support 131 may be adjusted up or down relative to an upper carriage extension 158. In this manner, the third joint hub 167 may be connected to a dovetail block 164 received in longitudinal slots 156 of the upper carriage extension 158. By loosening a nut 165, the dovetail block 164 may be positioned as desired along the upper carriage extension 158, best shown in FIG. 6.

Figure 8:
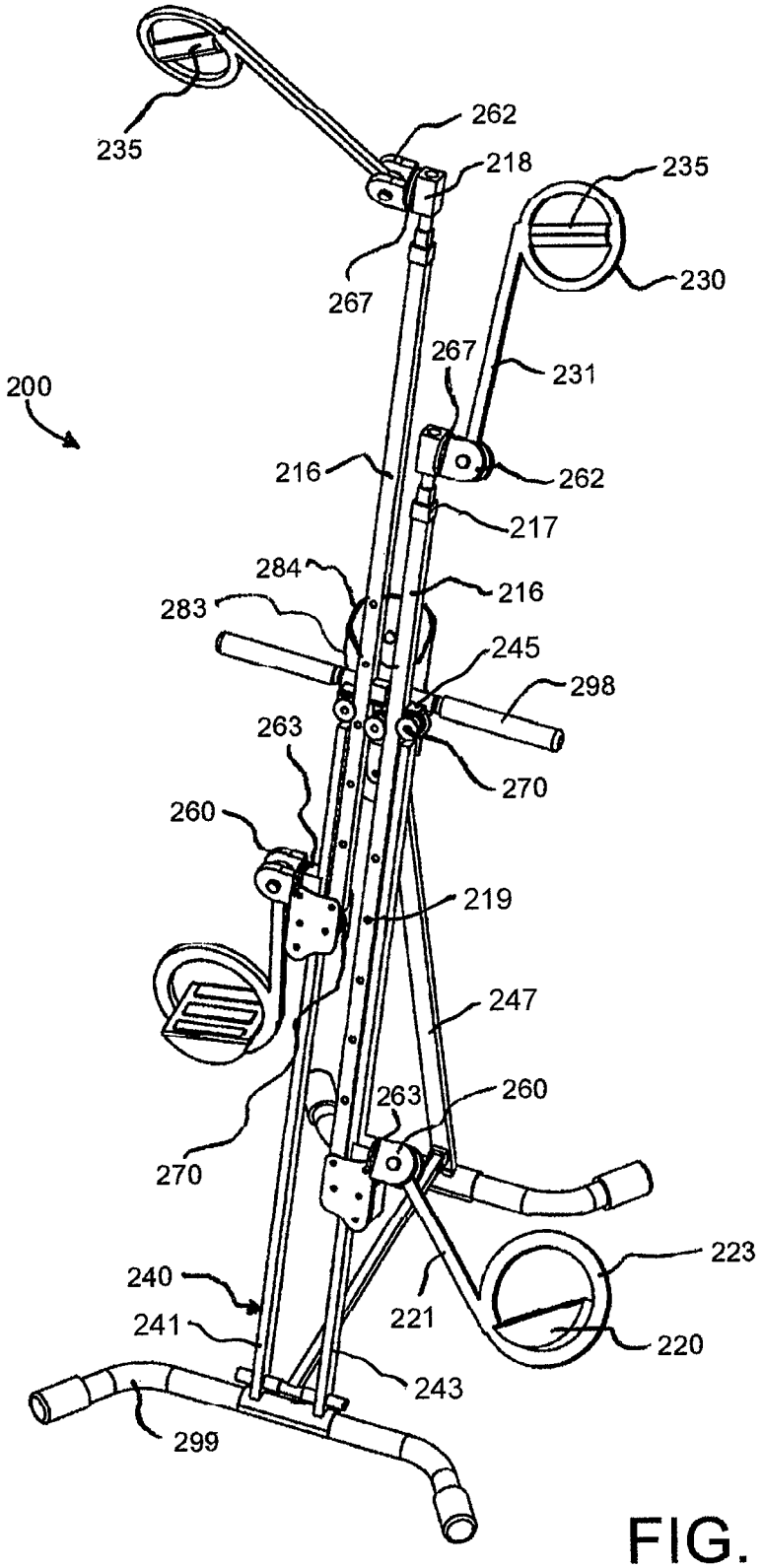
FIG. 8 is a perspective view of a second embodiment of a climbing exercise apparatus.
Figure 9:
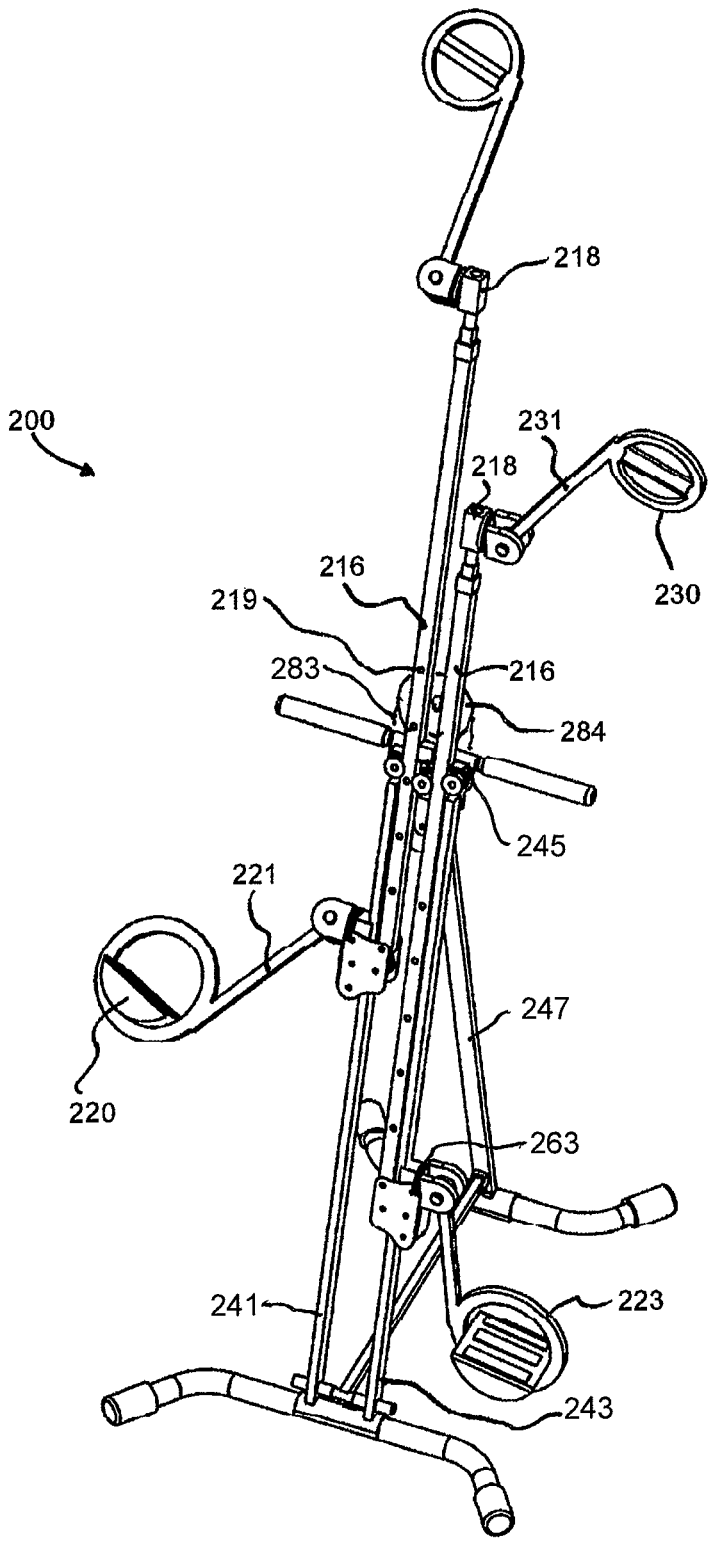
FIG. 9 is a perspective view illustrating vertical and three-dimensional movement of the climbing exercise apparatus shown in FIG. 8.
Figure 10:
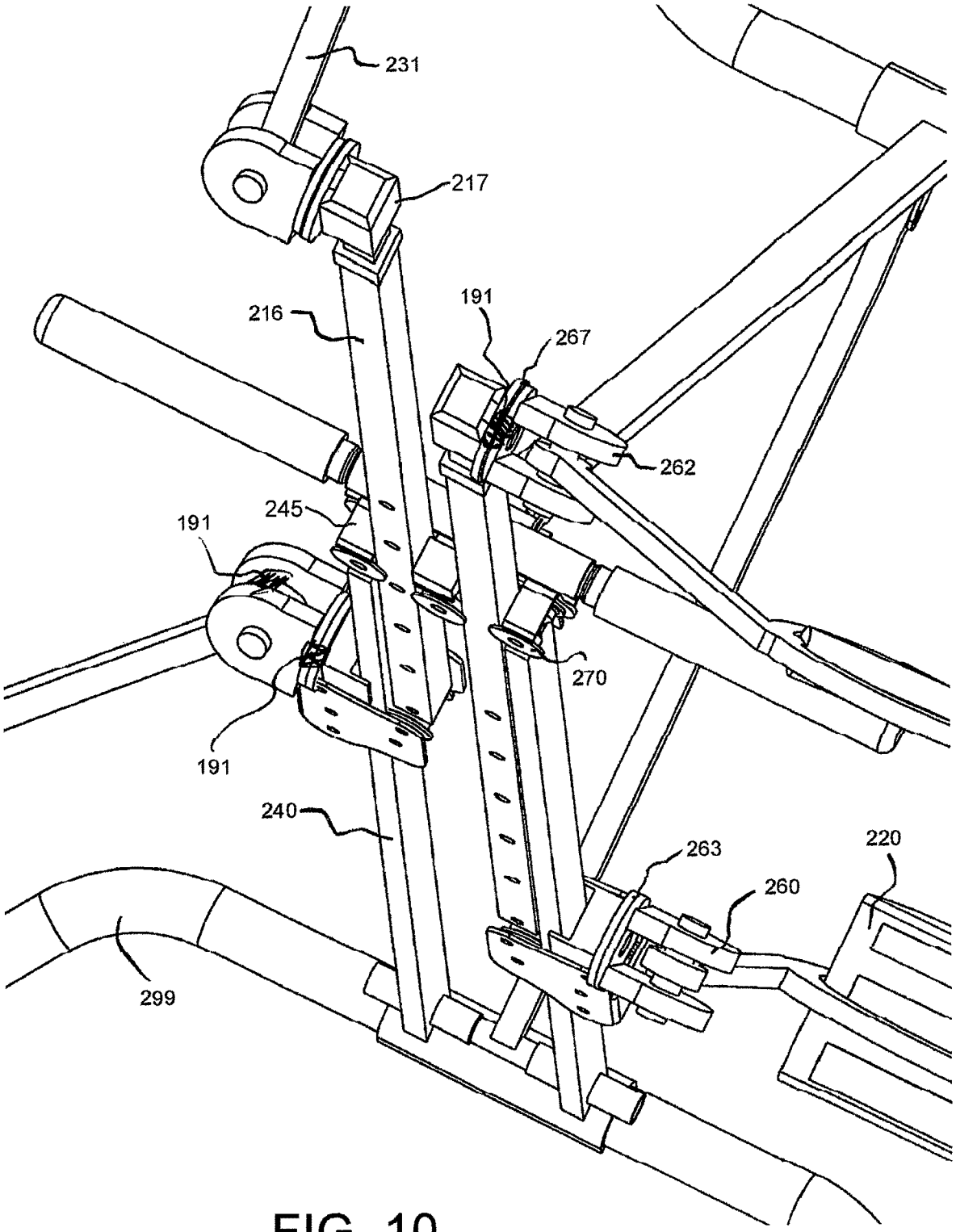
FIG. 10 is an enlarged partial perspective view of the climbing exercise apparatus shown in FIG. 8.

Referring now to FIGS. 8-10, a straight climbing exercise apparatus is generally identified by the reference numeral 200. The exercise apparatus 200 may permit a user's feet and arms to move in three dimensions (3D) as the user exercises, similar to the exercise apparatus 100. The exercise apparatus 200 may include a frame having a base member 299 and a stanchion 240 fixedly secured to the base member 299. The stanchion 240 may comprise generally vertically extending left and a right guide members 241 and 243. The left and right guide members 241, 243 may be spaced apart and connected proximate the upper distal ends thereof by a transverse bracket 245 bridging the space between the left and right guide members 241, 243 and maintaining a parallel relationship between one another. A generally angularly extending brace member 247 may have a lower end secured to the base member 299 and an upper end connected to the bracket 245. The left and right guide members 241, 243 may extend generally vertically upward from the base member 299 angled away from the user generally toward the rear of the base member 299.

The left and right guide members 241, 243 may movably support left and right carriage members 216. The carriage members 216 may be linearly reciprocated relative to the guide members 241, 243. Rollers 270 and the like may provide a linear bearing surface in a manner known in the art. Those skilled in the art will appreciate that linear constraints may also include any style of linear bearing, including for example polymer bushings that slide along and are concentric with polished shafts (unillustrated). In the instance of bushings that concentrically slide along a linear shaft, at least two shafts would be required in order to prevent the carriage from rotating about linear shaft(s).

A center pulley 284 may be rotatably secured to the frame 299 and a cable 283 may be routed over the pulley 284. The distal ends of the cable 283 may be secured to right and left carriages 216 such that dependent vertical motion of the carnages 216 occurs. For example, as the user pushes down on a first foot platform 220 (or carriage 216), the other foot platform 220 (or carriage 216) will be caused to move up.

The foot platforms 220 may be secured to foot support members 221, where foot support members 221 may be connected proximate a lower region of carriages 216. The foot support members 221 may be connected to the carriage members 216 in such a manner that in addition to allowing the right or left foot of a user to move generally up and down as the right and left carriages 216 move in opposite directions, the foot platforms 220 may move laterally as well as fore and aft, thus providing for foot movement during exercise in all three dimensions (3D movement). Similarly, the hand grips 235 (secured to arm support members 231) move generally up and down as carriages 216 reciprocate. The hand grips 235 may also move laterally as well as fore and aft, thus providing for arm movement, as well as foot movement, in all three dimensions (3D movement) during exercise. In order to provide lateral and fore and aft movement of the foot platforms 220 and hand grips 235, ball joints and the like may be utilized where foot support members 221 and arm support members 231 connect to carriages 216, however a double joint assembly described herein, may function in a similar manner as a ball joint. A double joint assembly has the additional advantage of disallowing spinning of the foot support members 221 and arm support members 231 about their respective axes during operation of the exercise apparatus 200. An unillustrated keyed ball joint assembly may also prevent such spinning about the axes of foot support members 221 and arm support members 231.

Continuing, and referring first to the connection of a foot support member 221 to the lower region of a carriage 216, a first joint hub 263 having rotational axis orientated similar to axis A100 (FIG. 1) may be established proximate the carriage 216, and a second joint hub 260 having rotational axis orientated similar to axis B100 (FIG. 1) may be established proximate the first joint hub 263. As previously mentioned, a ball joint configuration may alternatively be employed. Furthermore, friction disks may be utilized between opposed rotating surfaces as desired. In this manner, a foot platform 220 may travel up or down as a carriage 216 reciprocates along stanchion 240, while the foot platform 220 may simultaneously move fore and aft about an axis orientated similar to axis A100 (FIG. 1), and laterally side to side about an axis orientated similar to axis B100 (FIG. 1). Potentiometers 191 and the like may be incorporated into the hubs 263 and 260 in order to provide position feedback signals for numerous applications which will be discussed briefly below.

Referring now to a user's arm movements, similarly the hand support members 231 may be connected proximate the upper region of a carriage 216, and a third joint hub 267 having rotational axis orientated similar to axis C100 (FIG. 1) may be established proximate the carriage 216, and a fourth joint hub 262 having rotational axis orientated similar to axis D100 (FIG. 1) may be established proximate the third joint hub 267. In this manner, hand grip 235 may travel up or down as carriages 216 reciprocate along stanchion 240, while hand grips 235 may simultaneously move fore and aft and laterally side to side. Again, potentiometers 191 and the like may be incorporated into the third and fourth hubs 267 and 262, respectively, in order to provide position feedback signals for numerous applications. Friction disks may be utilized between opposed rotating surfaces as desired at any of the hub joints 263, 260, 267, and 262 in order to add resistance to the three-dimensional hand and/or foot motion.

Referring again to FIG. 8, hand rings 230 may be rigidly secured to arm support members 231, and hand grips 235 may include a gripping surface as well as a circumferential race which is concentric with the hand rings 230, such that a user may rotate the hand grips 235 about the axes of the hand rings 230 during exercise in order to seek the most natural articulation of the user's wrist. Additionally, a potentiometer 191 and the like may be connected between the hand grips 235 and the hand rings 230 in order to provide further interactive capability of the exercise apparatus 200 with any one of numerous possible computer applications.

The hand support members 231 may be adjusted up or down relative to carriage 216 to accommodate different user heights. The carriages 216 may include vertically spaced detent holes 219 for selectively adjusting the position of the hand support members relative to the carriages 216. An extension of the hand support members 231 may slide or telescope within respective carriages 216, and may include an outwardly biased member, such as, but without limitation, an outwardly biased pin and the like known in the art (not shown in the drawings) for selective engagement with the detent holes 219 to adjust the relative positions of the hand support members 231 and carriages 216 to accommodate the arm reach of a user.

Figure 11:
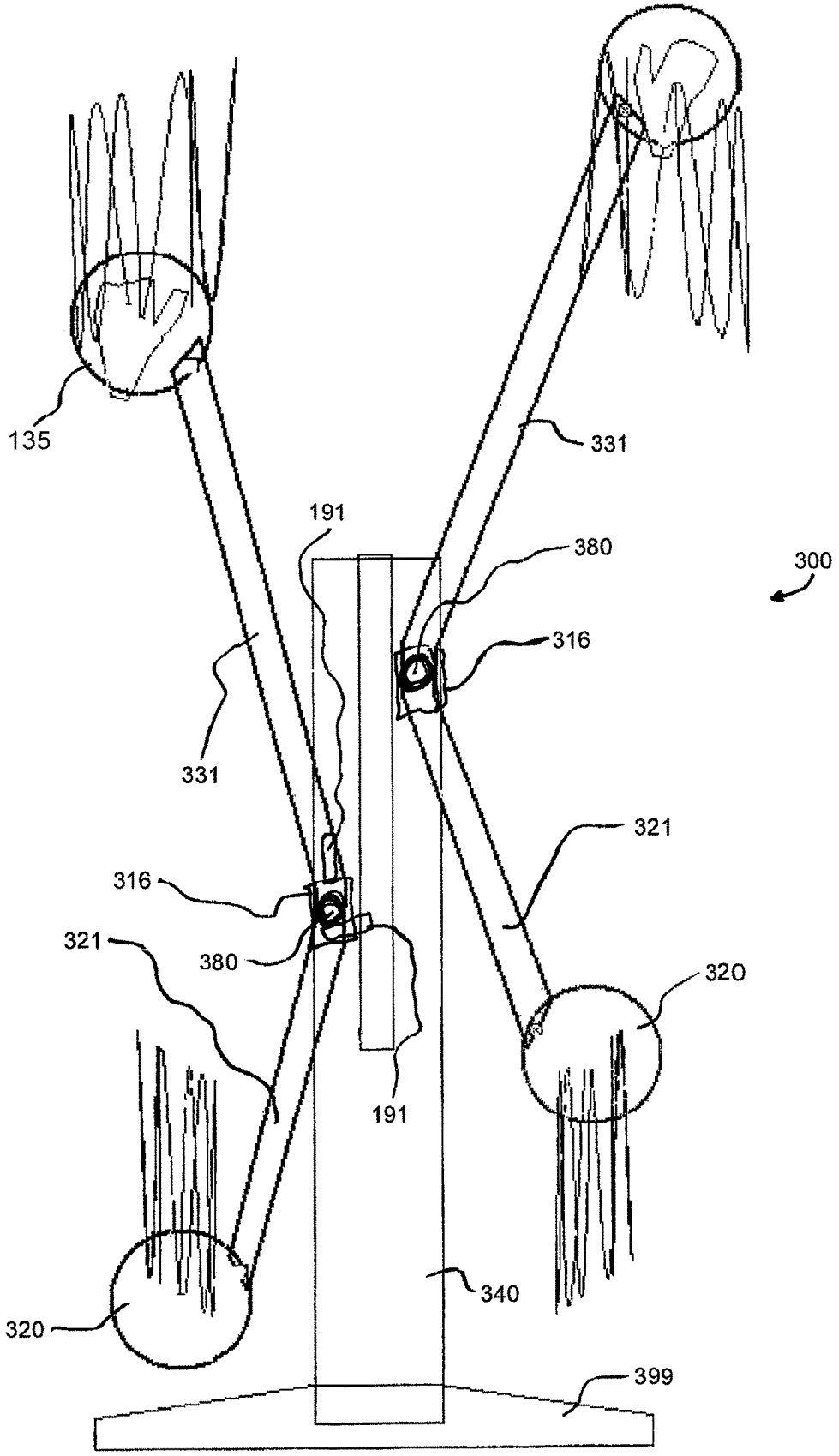
FIG. 11 is a side view of a third embodiment of a climbing exercise apparatus.

Referring now to FIG. 11, a third embodiment of a climbing exercise apparatus 300 is generally identified by the reference numeral 300. A foot platform 320 may be connected to foot support members 321, and hand grips 335 may be connected to arm support members 331. Right or left foot support members 321 may be rigidly secured to right or left arm support members 331 to form a unitary right longitudinal member and a unitary left longitudinal member. Carriages 316 may reciprocate vertically along a stanchion 340, while the right and left carriages 316 are connected to distal ends of an unillustrated cable which is routed over a central unillustrated pulley such that generally dependent vertical motion of the carriage is provided. Right and left ball joints 380 (or 'U joints') may be interconnected between respective right and left longitudinal members and respective right and left carriages 316. During exercise activity, the user's right hand and right foot may move with the right longitudinal member in a three-dimensional manner, and the user's left hand and left foot may move with the left longitudinal member in a three-dimensional manner, where the right and left longitudinal members may each be moved independently. As with the previous embodiments, position sensors and/or potentiometers 191 and the like may be disposed between any surfaces which move relative to each other, or alternatively accelerometers and the like may be employed to provide feedback to an interactive computer program. Furthermore, the user's position of hands and/or feet may be optically determined by a camera to provide the aforementioned feedback.

Figure 12:
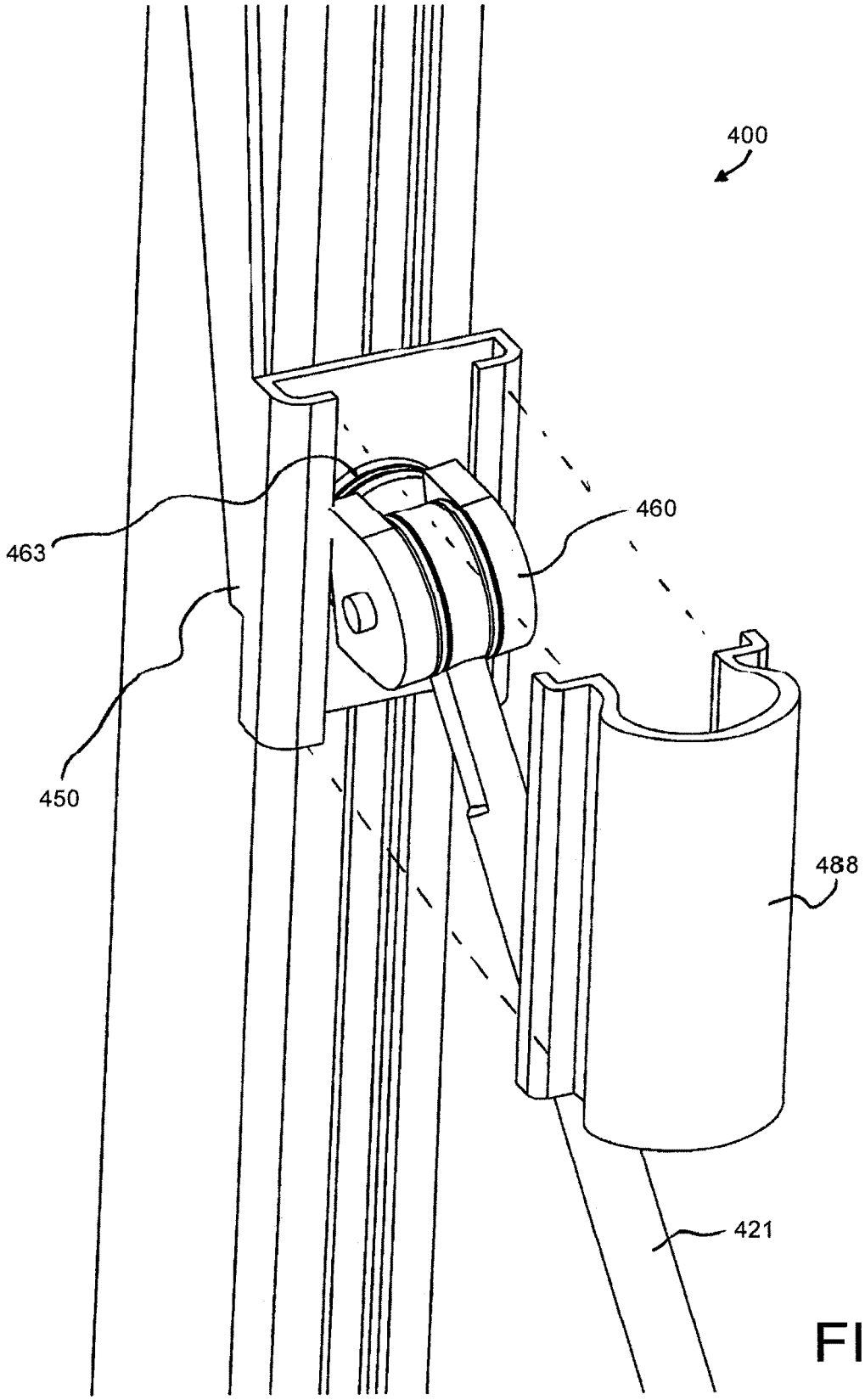
FIG. 12 is an enlarged partial perspective view of a fourth embodiment of a climbing exercise apparatus.

Referring now to FIG. 12, a fourth embodiment of a climbing exercise apparatus 400 may include a resistance elastomeric bumper 488 which when installed collides and deforms with a moving support member 421 such that resistance is provided to the fore and aft and/or lateral movements of the foot and/or hand support members.

Figure 13:
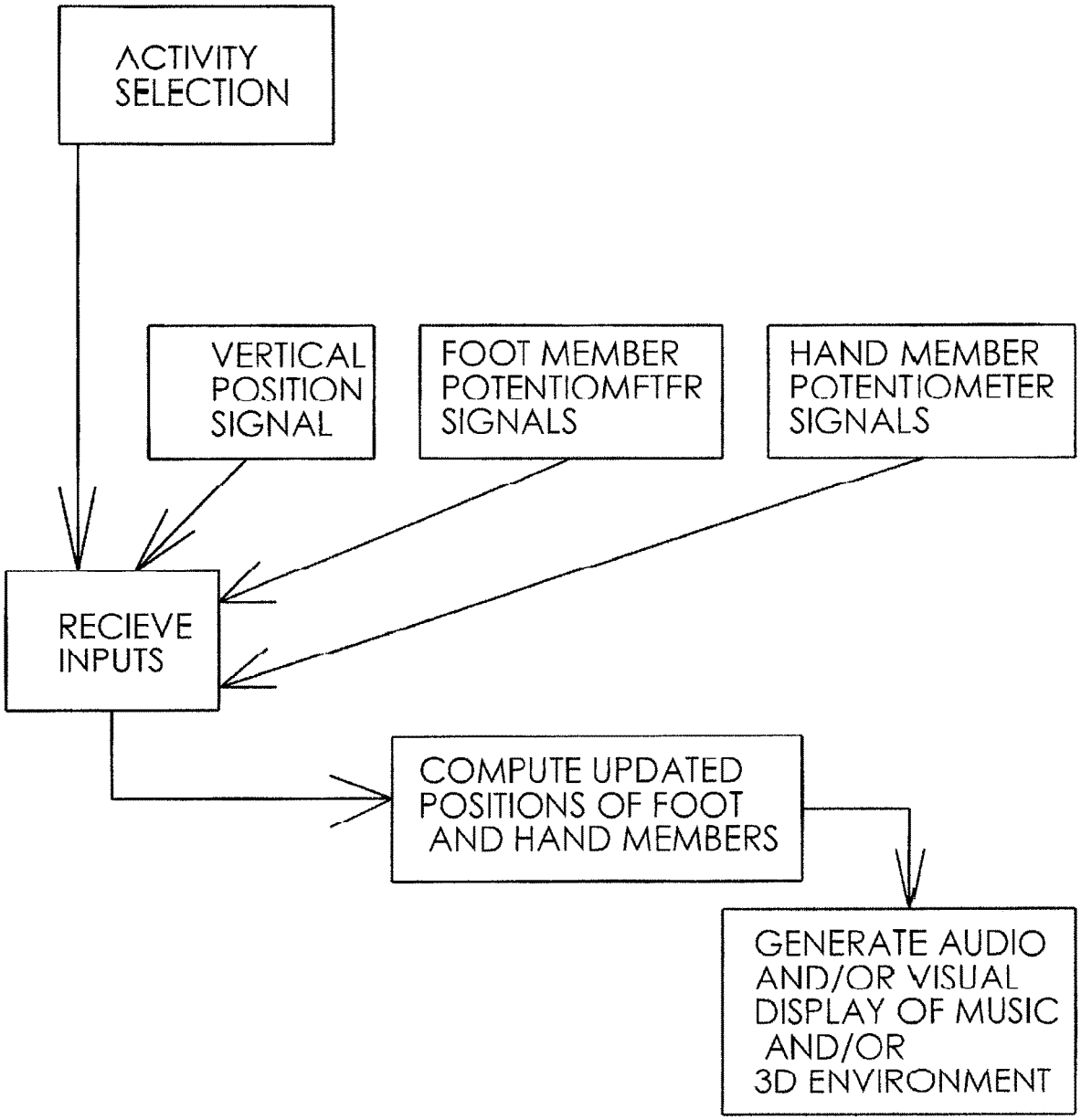
FIG. 13 is a flow diagram illustrating an interactive mode of a climbing exercise apparatus.

Referring to FIG. 13, a flow diagram is shown of the interactive exercise apparatus which allows engagement of the user's mind and body. For example, virtual objects may be interacted with such as while climbing a virtual mountain or walking along a virtual foot path; or alternatively the user may create music based upon a dancing movement where the three dimensional paths of motion of the user's feet and/or hands creates music. For example, reciprocating vertically at different rates may change the music tempo or beat based upon sensors updating the position of a carriage 150, while a change in any of the eight different potentiometer positions (two potentiometers at each 'U joint') results in different electrical signals being generated, which through a mixer would create different musical notes to be 'played'. Depending upon which foot or which hand is moving laterally, or which foot or hand is moving fore and aft, different octaves may be 'selected'. In another alternative, the user's arms or legs may each be associated with a different synthesized musical instrument, thus further providing what would be an infinite number of musical patterns which may be created while exercising.

The foregoing climbing exercise apparatus described herein are considered as illustrative only of the principal of the invention. Further, since numerous modifications and changes will readily occur to those skilled in the art, the invention is not limited to the exact construction and operation shown and described, and accordingly, other and further embodiments of the invention may be devised without departing from the basic scope thereof, and the scope thereof is determined by the claims which follow.

The invention claimed is:

1. A climbing exercise apparatus, comprising:

a) a frame including a base and a stanchion extending vertically upward from said base;

b) a first carriage and a second carriage movably connected to said stanchion;

c) an arm support member rotatably connected proximate an upper end of each said first carriage and said second carriage;

d) a foot support member rotatably connected proximate a lower end of each said first carriage and said second carriage; and e) wherein each said foot support member is configured to be movably connected to a respective said first carriage and said second carriage in such a manner to move through three-dimensional paths of motion.

2. The climbing exercise apparatus of claim 1 further comprising a double joint assembly connecting each said arm support member and said foot support member to a respective said first carriage and said second carriage.

3. The climbing exercise apparatus of claim 2 wherein each said double joint assembly includes a first joint hub rotatable about a first axis and a second joint hub rotatable about a second axis.

4. The climbing exercise of claim 2 wherein each said double joint assembly includes a potentiometer.

5. The climbing exercise apparatus of claim 2 wherein each said double joint assembly includes friction disks between opposing rotating surfaces.

6. The climbing exercise apparatus of claim 1 further comprising a hand grip connected to each said arm support member.

7. The climbing exercise apparatus of claim 6 further comprising an upper arm extension for adjusting a height of each said hand grip to accommodate the reach of different users.

8. The climbing exercise apparatus of claim 1 wherein said stanchion comprises a left guide member and a right guide member fixedly secured to said frame, said left guide member and said right guide member extending vertically in spaced, parallel alignment with one another.

9. The climbing exercise apparatus of claim 8 further comprising a transverse bracket connecting said left guide member and said right guide member at an upper end thereof.

10. The climbing exercise apparatus of claim 8 wherein said first carriage and said second carriage include vertically spaced detent holes.

11. The exercise apparatus of claim 1 further comprising a plurality of rollers linearly constraining said first carriage and said second carriage.

12. A climbing exercise apparatus, comprising:

a) a frame including a base and a stanchion extending vertically upward from said base;

b) a first carriage and a second carriage movably connected to said stanchion;

c) an arm support member rotatably connected proximate an upper end of each said first carriage and said second carriage;

d) a foot support member rotatably connected proximate a lower end of each said first carriage and said second carriage; and e) a joint assembly connecting each said arm support member and said foot support member to a respective said first carriage and said second carriage, wherein each said arm support member and said foot support member is configured to be movably connected to a respective said first carriage and said second carriage in such a manner to move through three-dimensional paths of motion.

* * * * *